United States Patent [19]

Semmler

[11] 4,207,845

[45] Jun. 17, 1980

[54] APPARATUS FOR CONTROLLING FUEL SUPPLY TO AN ENGINE

[76] Inventor: Franz Semmler, Albstrasse 167, 7332 Eislingen, Fed. Rep. of Germany

[21] Appl. No.: 754,941

[22] Filed: Dec. 28, 1976

[30] Foreign Application Priority Data

Feb. 12, 1976 [DE] Fed. Rep. of Germany ..... 2605436
Apr. 9, 1976 [DE] Fed. Rep. of Germany ..... 2615504

[51] Int. Cl.[2] ..... F02D 11/10

[52] U.S. Cl. ..... 123/102; 123/198 DB; 123/DIG. 11

[58] Field of Search ..... 123/198 DB, 110, 102, 123/DIG. 11

[56] References Cited

U.S. PATENT DOCUMENTS

| | | | |
|---|---|---|---|
| 3,570,460 | 3/1971 | Rabus | 123/102 |
| 3,673,992 | 7/1972 | Westberg | 123/102 |
| 3,699,935 | 10/1972 | Adlen | 123/102 |
| 3,736,910 | 6/1973 | Raff | 123/32 EA |
| 3,889,647 | 6/1975 | Rachel | 123/102 |
| 3,916,865 | 11/1975 | Kiencke et al. | 123/198 DB |
| 3,946,707 | 3/1976 | Gray | 123/102 |
| 3,978,837 | 9/1976 | Lundberg | 123/102 |

*Primary Examiner*—Ira S. Lazarus
*Attorney, Agent, or Firm*—Craig & Antonelli

[57] ABSTRACT

Apparatus for controlling fuel supply to an internal combustion engine includes means for interrupting the fuel supply, which means includes two devices operable independently of engine operating conditions. One of the devices is operated when a given engine speed and/or a given vehicle speed is exceeded with engine fuel supply regulating means in a no supply condition. The other of the devices is operated when a predetermined vehicle speed is exceeded.

25 Claims, 7 Drawing Figures

APPARATUS FOR CONTROLLING FUEL SUPPLY TO AN ENGINE

FIELD OF THE INVENTION

This invention relates to apparatus for controlling fuel supply to the engine of a powered vehicle, the apparatus comprising a selecting means, for example an accelerator pedal, for regulating the amount of fuel supplied. It is common practice to provide such a selecting means for regulating fuel supply and it is usually a pedal in powered vehicles. The engine output or speed of the vehicle can be selected by means of the selecting means.

An object of the invention is to provide a fuel supply control device by means of which fuel can be saved without engine operation or regulation of fuel being influenced in a way which can be detected by the user, and also to provide if required the facility that the vehicle does not exceed a predetermined maximum speed.

SUMMARY OF THE INVENTION

According to this invention apparatus for controlling fuel supply to an internal combustion engine comprises: fuel supply means; selecting means for regulating supply of fuel from the fuel supply means, the selecting means being movable to select a supply regulating condition between and including maximum supply and no supply; and means for interrupting the supply of fuel from the fuel supply means, characterised in that the said interrupting means comprises two actuating devices operable independently of engine operating conditions, one said actuating device being activated when a speed value is exceeded with the said selecting means in the no supply state and the other said actuating device being activated when a predetermined vehicle speed is exceeded.

The invention makes it possible for fuel consumption to be reduced, as the supply of fuel is interrupted when there is no positive output from the engine. Whenever over-run occurs and the selecting means, for example an accelerator pedal, is in the no supply condition, the supply of fuel is interrupted so that there is no consumption of fuel. If a predetermined engine or vehicle speed is not attained, then the fuel is automatically again supplied, so that the engine runs again as soon as the vehicle reaches a stationary condition. Substantially the same components may also be used to avoid exceeding a maximum engine or vehicle speed. Thus, when a given maximum speed is exceeded, the supply of fuel is interrupted so that the engine acts as a brake.

To achieve fuel saving during every type of over-run, provision may be made for a device which can be switched by at least one control element to interrupt the supply of fuel, as well as a device for monitoring engine speed and a device for monitoring the position of the selecting means, which monitoring devices may be interlinked via a control circuit which contains a fixed relationship between the positions of the selecting means and the engine speed, in such a way that whenever the engine speed is increased above the corresponding position of the selecting means, the control element for interrupting the fuel supply is operated.

In this way the fuel supply is interrupted whenever engine speed is greater than a speed which corresponds to the associated position of the selecting means. This obtains when no output is required from the engine. In particular, with a powered vehicle this is concerned with over-running, during which engine braking is at least partly required. The arrangement has the advantage that not only when the selecting means is brought back to its no supply condition is there an interruption of the fuel supply, but whenever the engine is over-running, which is independent of the position of the selecting means. In addition, a limit may be set on engine speed, so that excessive engine speed is prevented.

DESCRIPTION OF THE PREFERRED EMBODIMENTS

Figure 1:
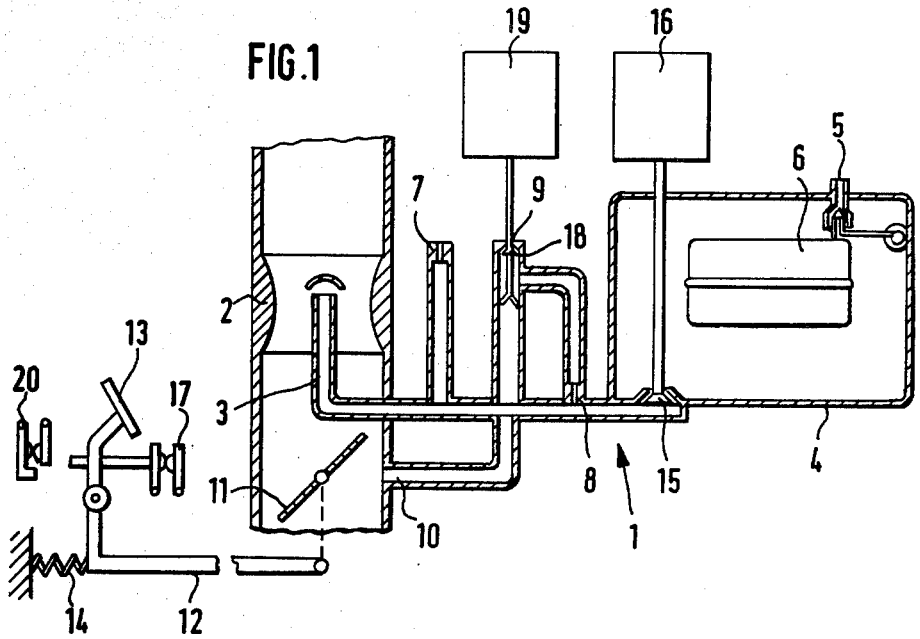
FIG. 1 shows schematically one embodiment of device, for an engine having a carburetor.

FIG. 1 shows an inverted-type carburetor 1 which is connected in a manner (not shown in detail) in front of an induction pipe of an internal combustion engine. A main jet 3 opens into a Venturi 2, the jet 3 being connected to a float chamber 4 which contains a float 6 controlling supply of fuel through a float valve 5. A main air jet 7 and an idling air jet 9 (the latter by an idling jet 8) to the connecting pipe between the main jet 3 and the float chamber 4. The idling jet 8 and the idling air jet 9 lead to an idling passage 10 which opens out downstream of a throttle valve 11. By means of the throttle valve 11 the output of the engine is preselected, and for this purpose the throttle valve is connected by a rod 12 to a throttle pedal 13 which is held in the throttle valve closed position by a coil tension spring 14. The throttle valve can be moved to the fully open position from the closed position shown, so that fuel supply is controlled by suction from the main jet 3 in the vicinity of the Venturi 2. In the closed position shown, to which the throttle valve is always returned by the spring 14, fuel is only drawn in by way of the idling passage 10, and the amount of such fuel is determined by adjustment of the idling jet 8 and the idling air jet 9 so that engine tick-over is satisfactory.

Fuel is supplied in the idling state not only during idling operation but when the pedal 13 is returned to its up position, so that the engine operates during over-running. In this event also fuel supply is maintained through the idling passage 10, although this is not in principle essential for satisfactory running of the engine.

To reduce fuel consumption, provision is made for the fuel supply to be stopped when the engine is over-running so that considerable fuel saving is obtained. For this purpose a device for interrupting fuel supply is in this embodiment a valve 15 closable by an electro-magnet 16 which constitutes a control element. The vvalve 15 is located at the outlet of the float chamber 4 so that when the valve 15 is closed the most that can occur is that the pipes to the idling passage 10, and if appropriate, to the main jet 3, just run dry, without the float chamber 4 becoming empty. The valve 15 and electromagnet 16 are designed so that the fuel supply is only interrupted when the electromagnet 16 is excited. Breakdown of the electrical circuit of the electromagnet 16 does not therefore lead to stoppage of the engine. In order also to prevent the pipes between the float chamber 4 and the idling passage 10 from being sucked dry during over-running, a further shut-off device is provided which closes the idling air jet 9 during over-running. For this purpose the jet 9 has a valve 18 actuated by an electromagnet 19 acting as a control means.

To ensure that the engine operates during over-running, two related criteria are referred to. On one hand the position of the pedal 13 is sensed, and on the other hand engine speed and consequent vehicle speed are monitored. These criteria are related in such manner that the valve 15 is closed only when the pedal 13 is in the up position, the vehicle is moving at a predetermined minimum speed, and the engine is turning at a minimum number of revolutions. If this vehicle or engine speed are not attained, or if the pedal is depressed, then the supply of fuel is immediately resumed.

Associated with the pedal are first and second electrical switches 17 and 20. The first switch is operated when the pedal is depressed and the second when the pedal is raised, as will be discussed below in more detail.

To ensure that, irrespective of the position of the selector device, the vehicle does not exceed a given maximum speed, preferably pre-set, (which has the advantage that the driver does not have to concentrate cosciously on restricting his speed, particularly when driving in urban traffic or in dense freeway traffic), provision is made for the device to be operated according to other appropriate criteria. In this case provision may also be made for fuel supply to be interrupted when the pre-set maximum speed is exceeded, until the vehicle returns to below the pre-set speed. When fuel supply is interrupted the engine acts as a brake so that there is fairly rapid speed reduction. In this case vehicle speed along suffices as the criterion for releasing the electromagnets 16 and 19. In practice, however, it is advantageous for reasons of safety if the vehicle can exceed the pre-set maximum speed, for example for overtaking, when this is necessary. For this purpose, the pedal 13 has associated with it a second contact 20 which is opened by the pedal and which cuts the supply of current to the electromagnets 16 and 19 when the pedal 13 is fully depressed so as to be approximately in its full throttle position.

The linking of the criteria and the recording of the criteria will now be described with reference to FIG. 2. The electrical components are assembled in a housing 21, which has a terminal block 22 for the connections to the electromagnets, to the switches 17 and 20 of the pedal 13, and to other elements. The electromagnet 16 is connected to ground at one side and at the other via the blocks 22 and leads in the housing to the positive terminal of a battery (not shown) which is connected to the block 22. In the connection between the electromagnet 16 and the positive terminal, the switch 20 of the pedal 13 is beyond an on/off switch 24. This switch 20 is normally closed and is opened only when the pedal is fully depressed, that is, in the full throttle position, or when strong acceleration is required. When the switch 20 is open the entire device is put out of operation, since the current supply from the positive terminal of the battery, by way of the switch 24, is interrupted.

In the supply lead for the electromagnet 16 are two relays 25 and 26 which are in parallel in relation to the electromagnet 16. The relay 25 is connected so that it controls interruption of the fuel supply during over-running, whilst the relay 26 is connected so as to limit the maximum speed of the vehicle. The relay 25 is connected by the normally closed switches 17 and 20 to the positive terminal of the battery. Current is therefore only supplied when the pedal 13 is in the up position, thus closing the contact 17. The relay 25 is also connected to a transistor 27, the base of which is supplied via the block 22 to a DC source or to a rectified AC source, the value of which depends on the speed of the engine and/or of the vehicle. For this purpose a connection to the ignition coil or to the magneto of the engine can be made. In this way, current is tapped in direct dependence on engine speed. It is also possible to connect the transistor 27 to a DC generator driven from a shaft of a tachometer, such as is frequently present in a vehicle. In this case, vehicle speed and indirectly engine speed are monitored. The transistor 27 is connected in such a way that it does not open until a minimum current is applied to its base, corresponding to a minimum engine speed or a minimum vehicle speed. The relay 25 switches a normally open switch 28 when the switch 17 is closed with increased engine speed, which is an indication that the vehicle is operating in over-run. The decisive engine speed for conductance of the transistor 27 is determined so that it is clearly some way removed from the engine idling speed, and also from a somewhat increased engine speed, which, for example, is determined by running up in a vehicle with automatic starting. The relay 25 also switches a normally closed second switch 29 which controls current supply to the electromagnet 19, which closes the idling air jet 9 via the valve 18. Whilst the switch 28 is open in normal operation, i.e. the electromagnet 16 is not excited, the switch 29 is closed in normal operation, so that the electromagnet 19 is excited, in order then to actuate the valve 18 via an integral spring or the like, to close the idling air jet 9 when excitation ceases. This has the advantage that whenever the engine is switched off, for example by switching off the ignition switch, the idling air jet 9 will be shut off. The supply of current to the electromagnet 19 must be conducted through the on/off switch 24 for the reason given.

The second relay 26 can similarly interrupt current supply to the electromagnet 19 via a switch 30 and, via a simultaneously operated switch 31, can supply the electromagnet 16 with current so that interruption of the fuel supply is also controlled by operation of the relay 26. In front of the relay 26, which serves as a control relay, a considerably more sensitive switching relay 32 is connected, which is activated according to a pre-set maximum speed and then switches the relay 26 via a switch 33. The switching relay 32 is connected at one side via the switch 20 to the positive battery terminal and at the other side to a transistor 34. The transistor 34 opens in dependence on an operating condition of which it is informed, namely, vehicle speed. The base of the transistor 34 is supplied with a current which is dependent on vehicle speed. For this purpose a DC generator, for example, which is driven by the shaft of a tachometer, can be connected via the connecting block 22 to the base of the transistor 34. In the supply to the transistor a voltage divider 35 is arranged by which the voltage at which the transistor 34 conducts, i.e. the corresponding maximum vehicle speed, can be adjusted. Outside the housing 21 and in the dashboard area of the vehicle, a potentiometer 36 can be provided, and which in the present embodiment is a sliding potentiometer. By way of this potentiometer one or two control lights 37 and 38 are also connected, for indicating operation of the device for interrupting fuel supply.

Figure 2:
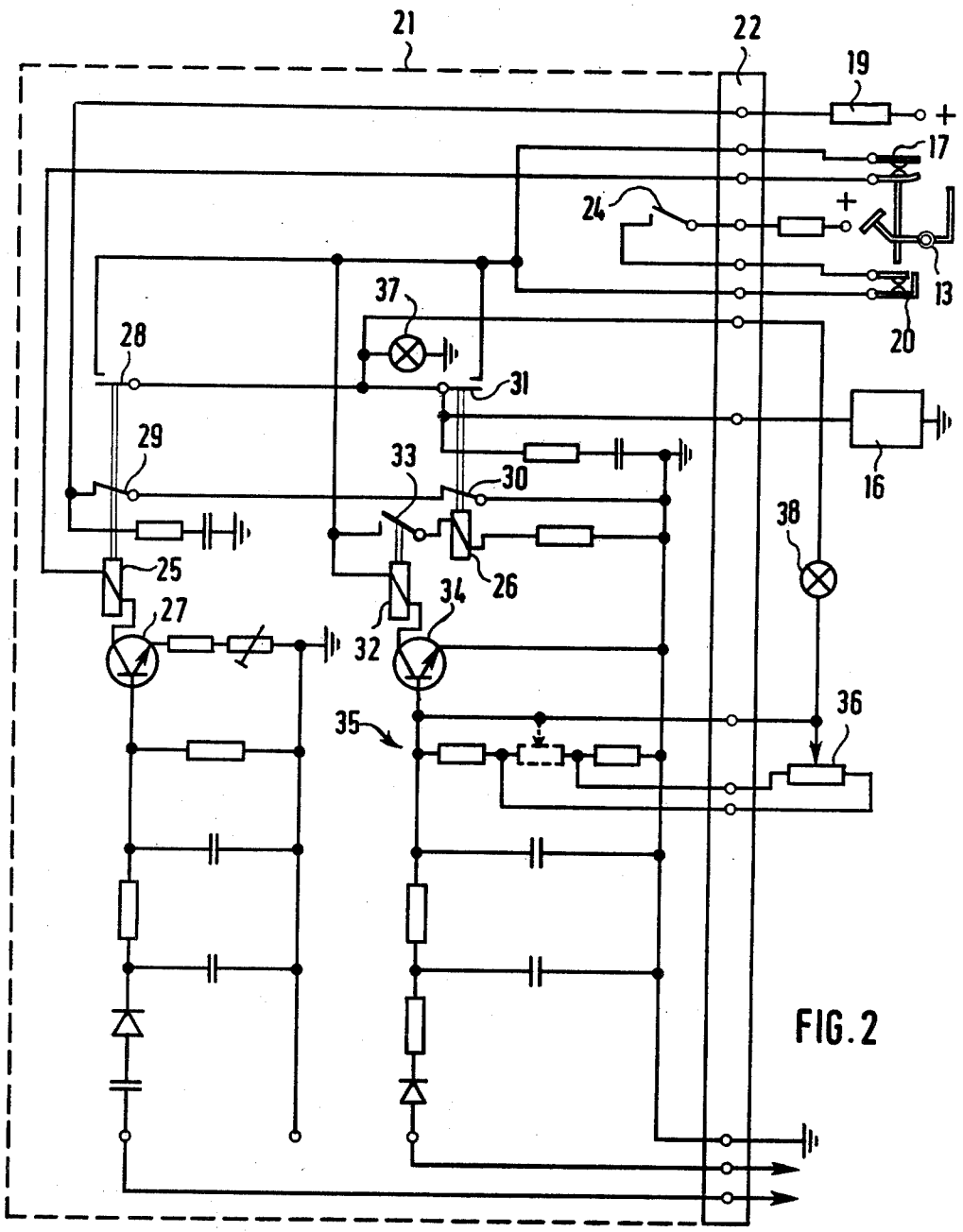
FIG. 2 is an electrical circuit diagram.

The circuit shown in FIG. 2 can also be installed for an internal combustion engine which is fitted with an injection pump. In this case the electromagnet 16 is arranged so that it activates the adjustment element of the injection pump under the described operating conditions so that fuel supply is interrupted. In normal circumstances the electromagnet 19 and its associated circuit elements can then be dispensed with. The return of the adjustment element of the injection pump to obtain a nil supply is not noticed by the driver of the vehicle is the throttle pedal 13 is in the up position, i.e. the driver is not aware of the processes which proceed automatically in order to achieve fuel saving when the vehicle is over-running. However, if the device for interrupting fuel supply is activated by return of the adjustment element when a maximum speed is exceeded then normally the accelerator pedal is also moved by means of this adjustment element towards its up position, which could irritate the driver of the vehicle, as there is then a movement counter to the direction desired by him.

Figure 3:
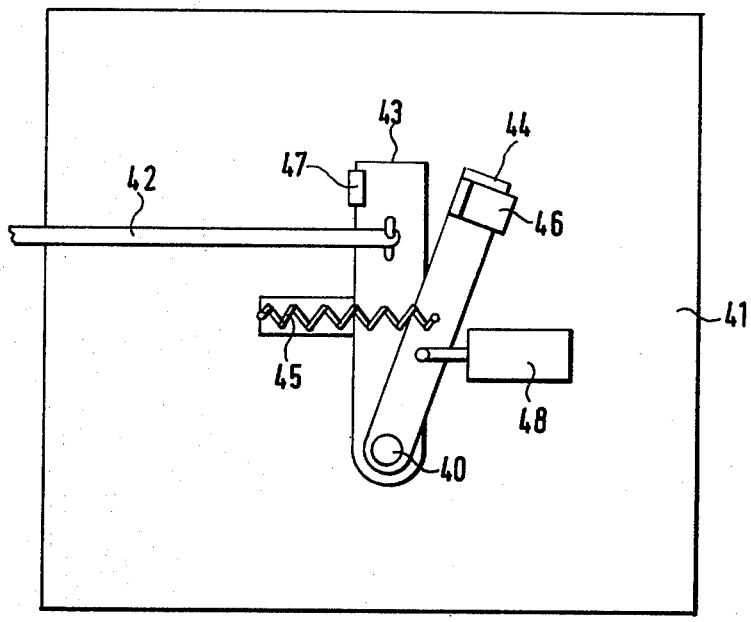
FIG. 3 is a detail of another embodiment of device, for fuel-injection engine.

To avoid this, the system of FIG. 3 can be provided, in which the position of the pedal 13 is not affected when the device for interrupting fuel supply is activated. Normally, on a pivot shaft 40 of an injection pump 41 an adjusting lever is arranged which is connected to the pedal via a rod 42. The shaft 40 is fixed to the adjusting lever and when rotated it actuates further adjustment elements of the injection pump which lead to a control rod. In the embodiment of FIG. 3 the adjusting lever is constituted by two levers 43 and 44 on the shaft 40. The rod 42 is pivoted to the lever 43 which is mounted freely on the shaft 40. The lever 44 on the other hand is fixed to the shaft 40. The connection between the two levers 43 and 44 which is necessary for normal operation is formed by a spring 45 and an electromagnet 46 which is connected to the lever 44 and with which a mild steel plate 47 on the lever 43 is associated. Under normal circumstances the electromagnet 46 is excited so that the two levers 43 and 44 form a single unit and are moved in unison by the rod 42. Further, the lever 44 is acted on by an electromagnet 48 which is not normally energised but which when energised will pull the lever 44 to the position shown. This position of the lever 44 corresponds to nil fuel supply. When the lever 44 is moved back to the lever 43 the idling supply of the injection pump 41 is set up. A further movement of the lever 44 in the counter-clockwise direction leads to an increase of the injected amount above the idling amount, as desired by the driver.

If provision is made for the electromagnets 46 and 48 of FIG. 3 to be connected into the circuit shown in FIG. 2 instead of the electromagnets 19 and 16, i.e. the electromagnet 46 corresponding to the electromagnet 19 and the electromagnet 48 corresponding to the electromagnet 16, then similarly fuel saving ensues when the vehicle is over-running and in which a restriction to a maximum vehicle speed can be brought about by interruption of the fuel supply. When one relay 25 or 26 connects for the reasons already stated, then the electromagnet 46 frees the connection between the two levers 43 and 44, whilst the electromagnet 48 moves the lever 44 back into the nil supply position. The tension spring 45 ensures that the lever 44 is moved back again from this position so that when one of the switches 17 or 20 is opened or the operating conditions which release the connection no longer prevail, then a connection can again be formed between the levers 43 and 44 by means of the electromagnet 46. The driver is hardly aware of the resulting restriction, since only the lever 44, which is not connected to the pedal 13, is involved.

The arrangement of FIG. 3 can be laid out differently; for instance, provision can be made for one double-acting magnet to be used instead of the two separate magnets 46 and 48.

It would be possible, on entry into a speed restriction zone for example, for a signal, to be produced by a signal transmitter at the entrance to the zone, which signal is picked up by a receiver in the vehicle, to cause operation of the present device to limit the vehicle speed to a given maximum. Further, provision can be made for various signals to be emitted, according to prescribed permitted speeds, and which can also cancel out in the vehicle a setting of the potentiometer at a particular speed value. A signal transmitter could be incorporated, for example, in a speed limit sign.

Figure 4:
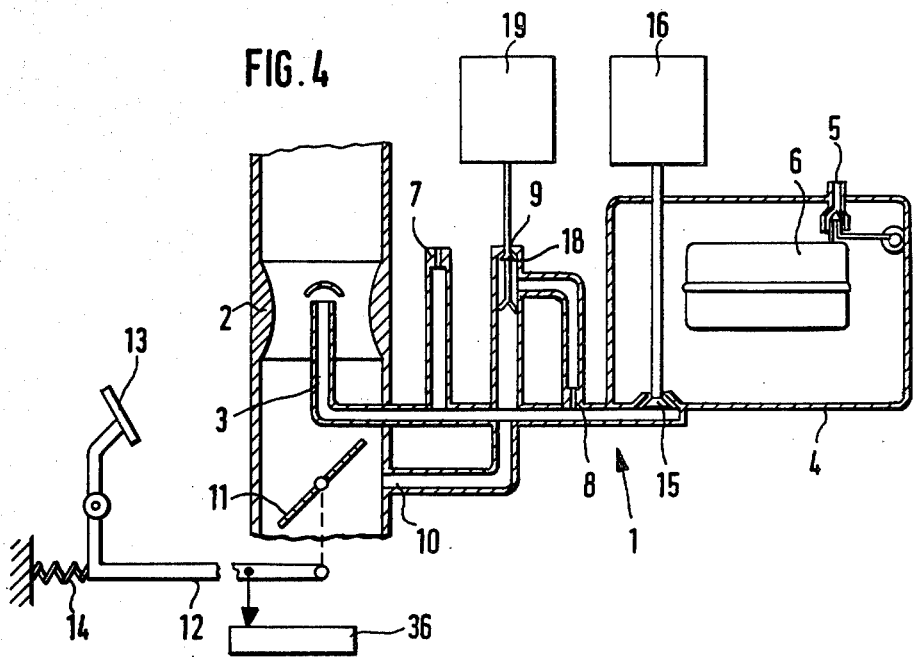
FIG. 4 shows schematically another embodiment of device, for a carburetor engine.

The embodiment of FIG. 4 corresponds generally to that of FIG. 1. To establish whether the engine is operating during over-running, two criteria are referred to and linked together. Firstly, the position of the throttle pedal 13 is monitored and secondly, the engine speed or, where appropriate in a vehicle equipped with an internal combustion engine, vehicle speed is measured. As a basis, the fact is used that a particular engine speed or, depending on the selected gear, a particular vehicle speed is associated with a particular position of the throttle pedal. If the engine or vehicle speed is exceeded, then this is an indication that the engine is operating in over-run. As in this case it is not called upon to supply driving power, there is also no difficulty if the fuel supply is now turned off. This is based on the fact that normally even when the accelerator pedal is up, an appreciable amount of fuel is still being consumed by the engine although it is not necessary for the operating conditions in question, and in fact may even be undesirable.

The linking of the criteria and the recording of the criteria will now be described with reference to the circuit diagram of FIG. 5, which corresponds largely to the circuit of FIG. 2, so that the same reference numerals are used for corresponding parts. The electrical components are assembled in a housing 21 which has a connection block 22 by which connections to control elements and to other elements outside the housing are made. The electromagnet 16 is connected at one side to ground and at the other side via the block 22 and leads in the housing 21 to the positive terminal of a battery (not shown) also connected to the block 22. In the connection between the electromagnet 16 and battery is an on/off switch 24 by which the whole device can be cut out.

In the supply lead to the electromagnet 16 is a relay 26. It can form the connection between the positive battery terminal and the electromagnet 16 via a normally open switch 31, and also can open a normally closed switch 30. The switch 30 connects the electromagnet 19, which is similarly connected to the positive battery terminal to ground. The electromagnet 19 is continuously energised so long as the switch 30 is not opened. This has the advantage that whenever the engine is switched off the idling air jet 9 is shut. So that the supply of current to the electromagnet 19 is not dependent on the operating conditions of the device, the supply is by way of the on/off switch 24. In front of the relay 26 a considerably more sensitive switching relay 32 is connected via the switch 24 at one side to the positive battery terminal and at the other side to a transistor 34.

A voltage, which depends on engine speed, is applied to the base of the transistor 34. For example, the current which is depending on engine speed can be tapped for example for an ignition coil. In front of the transistor 34 is a voltage divider 35 by which is determined that the value of the engine-speed-dependent current which can actually be conducted to the base of the transistor 34. This voltage divider 35 includes a potentiometer 36 by means of which it is possible to establish when the transistor 34 conducts.

The potentiometer 36 is mechanically connected to the accelerator pedal 13 so that the current at which the transistor 34 conducts depends on the position of the accelerator pedal 13. Thus, a specific voltage at which the transistor 34 conducts and interrupts the fuel supply is associated with each position of the accelerator pedal 13. This voltage can only be obtained when the engine-speed-dependent current supplied to the transistor or to the voltage divider 35 attains a value which is still sufficient after division to bring about conduction. In this way an exact relationship between the position of the pedal 13 at any given moment and the engine speed can be obtained.

Representation of the electrical switching elements and of the relays is purely diagrammatic. Appropriate electronic switching elements can be and have been used.

In practice the engine or vehicle speed which is achieved at a particular accelerator pedal position depends amongst other things on the demand on the internal combustion engine, for instance on the loading of the vehicle. If the engine is subject to a heavy demand then a lower engine speed will obtain at a particular pedal position than would obtain at the same pedal position with no demand on the engine. In practice, therefore, a reconciliation of these extremes must be sought. In most cases it will be satisfactory for the design to be such that an engine speed which is never reached, even under most favourable operating conditions, is associated with the pedal position, so that particularly with a vehicle the maximum output or the maximum speed can always be attained. If the variations in demand are great then provision should be made to make it possible to adjust the relationship between the position of the pedal and engine speed. This may be done, for example, by creating a length adjustment facility for a connecting member 50 between the pedal 13 and the potentiometer 36. In this way the position of the potentiometer 36 in relation to the position of the pedal can be varied according to the load on the engine.

Figure 5:
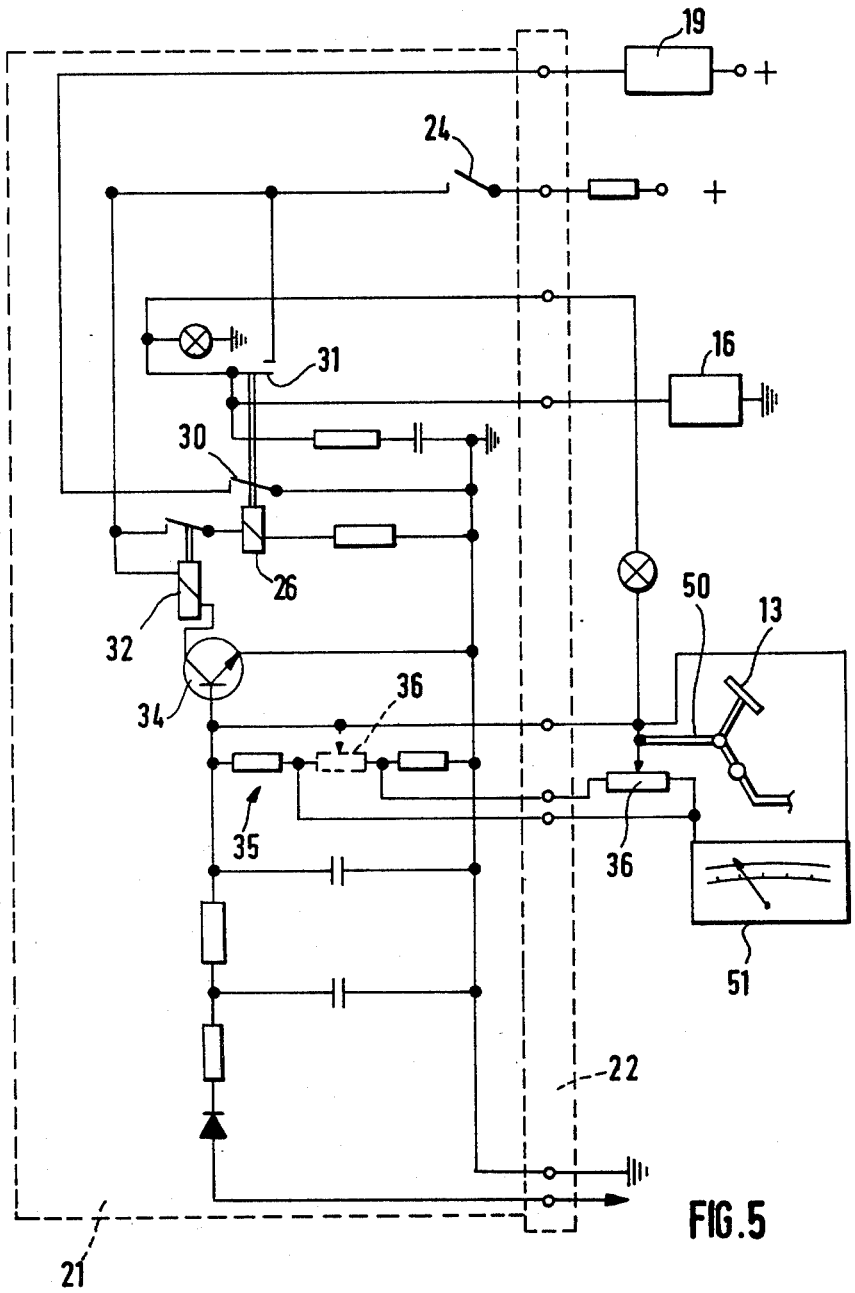
FIG. 5 is an electrical circuit diagram for the device of FIG. 4.

FIG. 5 also shows an indicating device 51 connected to the potentiometer 36, and arranged, for example, on the dashboard of the vehicle. This device 51 indicates a value corresponding to the position of the pedal and of the potentiometer. It can be calibrated so that this value corresponds to the vehicle speed which can be attained with the associated engine speed, so that the driver of a vehicle equipped in this manner can see what maximum speed he can obtain with the actual position of the accelerator pedal.

The device can also be used to set up, for example, a maximum travel speed for a vehicle, which depends not on technical vehicle data but on traffic conditions or traffic regulations or the like. For this, provision can be made for a preferably adjustable supplementary device to ensure that the potentiometer cannot be adjusted in the direct gear of the vehicle above a certain value with which a certain travel speed, dependent on engine speed, is associated. When this speed is exceeded the fuel supply is interrupted as already described, so that the engine is automatically speed regulated by means of the device as described.

Figure 5A:
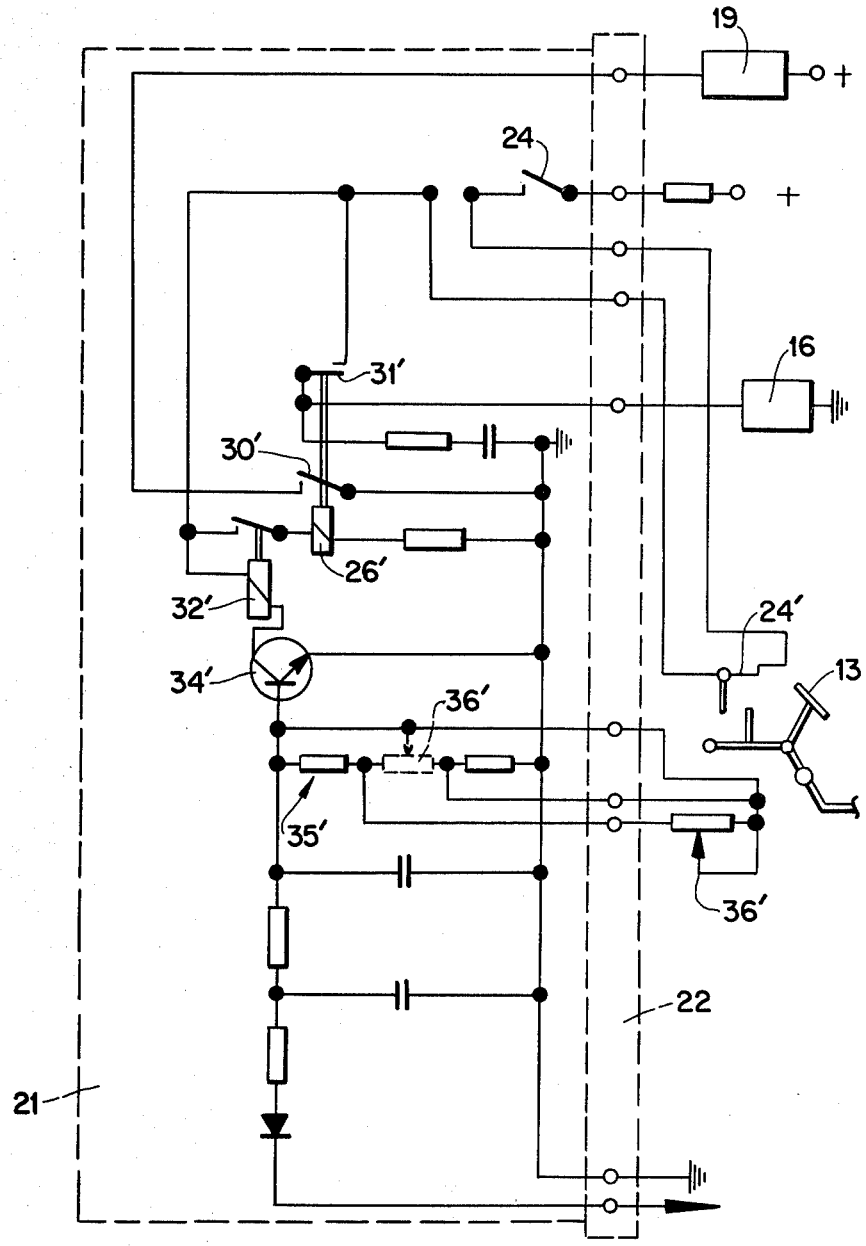
FIG. 5A is a second electrical circuit diagram for the device of FIG. 4.

For limitation of maximum speed, however, a second control circuit for the control elements 16 and 19 can also be provided which can be virtually identical with the control circuit of FIG. 5. Such a second control circuit is shown in FIG. 5A. In this second control circuit the base of the transistor 34' is connected to a voltage generator operating proportionally with vehicle speed, for example, to a tachometer shaft. In addition, in the voltage divider a potentiometer 36' which can be set at a constant value is, provided its setting corresponding to the required maximum speed. In this instance, for an additional switch 24' is fitted to the pedal and arranged in series with the on/off switch 24, and which switches off the entire device in the full throttle position of the pedal.

As a modification provision can also be made for the devices for monitoring engine speed and the position of the accelerator pedal to be connected as signal transmitters to a computer, which can actuate the control elements 16 and 19. The computer is fed with a programme which contains the course of the relationship between pedal position and engine speed. If deviations from this pre-set programme occur in the direction of increased engine speed, then the control elements 16 and 19 would be switched. Provision could be made for the computer to store several programmes, corresponding to several gear ratios.

The circuit of FIG. 5 can be laid out in a simple manner so that the transistor 34 only conducts at a minimum voltage which is preferably set so that the engine speed associated with it is clearly separate from the idling engine speed, and preferably also from a somewhat higher engine speed, determined, for example, by the running-up of a vehicle with automatic start. Under certain circumstances provision can also be made for an additional on/off switch which is controlled according to engine speed and which cuts out the whole device when that speed falls below a minimum, so that when a vehicle equipped with the device is braked to a standstill, the engine is not stalled but, before the vehicle comes to rest, is kept running by renewed switching in of the fuel supply.

Figure 6:
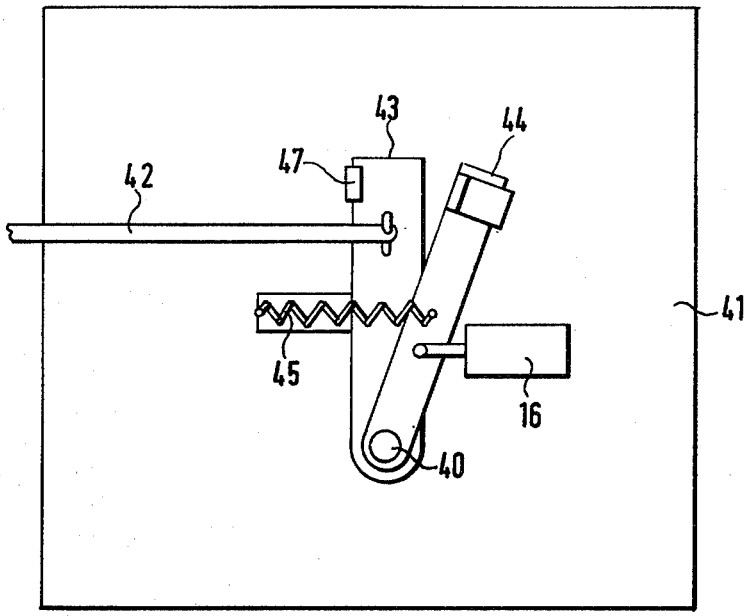
FIG. 6 is a modification of the embodiment of FIGS. 4 and 5, for a fuel-injection engine.

FIG. 6 is similar to FIG. 3, but for an engine having an injection pump 41. For this embodiment the circuit of FIG. 2 can be used, with omission of the control element 19. The injection pump 41 has a pivot shaft 40 for a two-part adjusting lever on which the rod 42 connected to the accelerator pedal acts. The adjusting lever includes a part 43 to which the rod 42 is connected and which part 43 is mounted freely on the shaft 40. The lever 44 is fixed to the shaft 40. The electromagnet 16 and the tension spring 45 act on the lever 44. The spring 45 tends to draw the lever 44 against stop 47 so that the two levers 43 and 44 become superimposed. If now the electromagnet 48 is energised due to the circumstances already mentioned, then it moves the lever 44 to the FIG. 3 position, which corresponds to no supply by the injection pump. This movement is carried out without the lever 43 and the rod 42 being entrained, so that the driver, who still has his foot on the accelerator pedal, is largely unaware of this automatically occurring operation.

It is also possible to apply to the base of the transistor 34 a voltage which depends on a vehicle speed controlled in the manner described. In this case it is satisfactory for the device to operate only in the direct drive gear range and where appropriate in the range of the preceding gear, as a satisfactory design for all gear ratios would be complex. In this instance, it would be satisfactory to provide in addition a control circuit for the control elements 16 and 17 which switch in the device for interrupting the fuel supply when it is established by other criteria that the engine is over-running. The position of the accelerator pedal and the engine speed can equally be referred to as criteria, and on the basis it can be assumed that there is over-running when the accelerator pedal is in its rest position and the engine speed exceeds its idling speed. Sensors can be provided which monitor these conditions and interrupt the fuel supply when both conditions are present, i.e. the accelerator pedal is in the rest position and engine speed is higher than the idling speed. In this instance the device could also be installed for setting a maximum vehicle speed.

What is claimed is:

1. Apparatus for controlling fuel supply to a vehicle internal combustion engine, comprising: fuel supply means; selecting means for regulating supply of fuel from the fuel supply means, the selecting means being movable to select a supply regulating condition between and including maximum supply and idling supply; and means for interrupting the supply of fuel from the fuel supply means, characterized in that the said interrupting means comprises two actuating devices operable independently of engine operating conditions, one said actuating device being activated when a speed value is exceeded with the said selecting means in the no supply state and the other said actuating device being activated when a predetermined vehicle speed is exceeded and wherein the said interrupting means comprises a control device and means for switching the said control device, and wherein the apparatus further comprises means for monitoring engine speed and means for monitoring the state of the said selecting means, the two said monitoring means being linked together in a control circuit which provides a fixed relationship between the state of the said selecting means and engine speed, in such manner that whenever engine speed exceeds that speed which is associated with a predetermined state of the selecting means, that is, whenever the engine is over-running, the said switching means operates the said control device to interrupt the supply of fuel to effect a considerable fuel saving.

2. Apparatus according to claim 1 wherein the said speed value is a predetermined engine speed.

3. Apparatus according to claim 1 wherein the said speed value is a vehicle speed which corresponds to a predetermined engine speed.

4. Apparatus according to claim 2 wherein the said one actuating device is activated when the predetermined engine speed and a vehicle speed corresponding to the said engine speed are both exceeded.

5. Apparatus for controlling fuel supply to a vehicle internal combustion engine, comprising: fuel supply means; selecting means for regulating supply of fuel from the fuel supply means, the selecting means being movable to select a supply regulating condition between and including maximum supply and idling supply; and means for interrupting the supply of fuel from the fuel supply means characterized in that said interrupting means comprises a control device and means for switching the said control device, and wherein the apparatus further comprises means for monitoring engine speed and means for monitoring the state of the said selecting means, the two said monitoring means being linked together in a control circuit which provides a fixed relationship between the state of the said selecting means and engine speed in such manner that whenever engine speed exceeds that speed which is associated with a predetermined state of the selecting means, that is, whenever the engine is over-running, the said switching means operates the said control device to interrupt the supply of fuel to effect a considerable fuel saving.

6. Apparatus according to claim 5 wherein the said control circuit includes a comparing device and a value store, signals from the two said monitoring means being fed to the said comparing device which compares the said signals with values in the said store.

7. Apparatus according to claim 5 wherein the said control circuit includes a switching element and means for providing a signal in dependence on the state of the selecting means, the said last-mentioned means feeding the said last-mentioned signal to the switching element to form a switching threshold value.

8. Apparatus according to claim 7 wherein a control circuit which contains the said control device includes a relay controlled by a transistor to the base of which are connected a generator and a voltage divider, the said generator being arranged to operate in synchronism with engine speed and the said voltage divider including a potentiometer mechanically connected to the said selecting means.

9. Apparatus according to claim 8 comprising an indicator device connected directly to the said selecting means, the said indicator device indicating a speed possible with a given state of the said selecting means.

10. Apparatus according to claim 8 comprising an indicator device connected by way of the potentiometer to the said selecting means, the said indicator device indicating a speed possible with a given state of the said selecting means.

11. Apparatus according to claim 9 wherein the speed is engine speed.

12. Apparatus according to claim 9 wherein the speed is vehicle speed.

13. Apparatus according to claim 10 wherein the speed is engine speed.

14. Apparatus according to claim 10 wherein the speed is vehicle speed.

15. Apparatus according to claim 5 comprising a second control circuit, which includes the said control device, and vehicle speed monitoring means in the said second circuit, whereby the said control device is operated when a predetermined maximum vehicle speed is exceeded.

16. Apparatus according to claim 5 comprising a control element which causes operation of the said control device if a predetermined engine speed is not attained.

17. Apparatus for controlling fuel supply to an internal combustion engine, comprising fuel supply means; selecting means for regulating the supply of fuel from the fuel supply means, the selecting means being movable to select a supply regulating condition; and means for effecting an interruption of the supply of fuel from the fuel supply means whenever the engine is over-running, which is independent of the position of the selecting means whereby considerable fuel saving is obtained.

18. Apparatus according to claim 17 wherein the said interrupting means includes a control device, two independent electrical circuits and an electrical supply line, the control device being connected by the said circuits to the said electrical supply line.

19. Apparatus according to claim 18 comprising an electrical switch in the said supply line, said switch being associated with the said selecting means such that said switch is closed when the said selecting means is in the no supply state.

20. Apparatus according to claim 18 comprising an electrical switch in the said supply line, said switch being associated with the said selecting means such that said switch is opened when the said selecting means is in the maximum supply state.

21. Apparatus according to claim 18 comprising a first electrical switch in the said supply line, the said first switch being associated with the said selecting means such that the said first switch is closed when the said selecting means is in the no supply state, and further comprising a second electrical switch in the said supply line, the said second switch being associated with the said selecting means such that the said second switch is opened when the said selecting means is in the maximum supply state.

22. Apparatus according to claim 1 for controlling fuel supply to an internal combustion engine which has a carburetor, wherein the said interrupting means comprises two control devices and means for switching the said control devices in unison, one said control device actuating a fuel shut-off valve of the said fuel supply means and the other said control device actuating an idling air jet shut-off valve in the said carburetor.

23. Apparatus according to claim 1 for controlling fuel supply to an internal combustion engine which has a fuel injection system including an injector pump, wherein the said interrupting means includes an adjustment lever on the said pump and a connection from the said lever to the said selecting means, the said connection being constituted by at least one control device.

24. Apparatus according to claim 23 wherein the said lever is a two-part lever, the said two parts being connected by the said at least one control device, a further control device being arranged to act on the said lever part which is connected to adjust the said injector pump.

25. Apparatus according to claim 24 wherein the said two lever parts are mounted for angular movement about a common shaft of the said injector pump, one said lever part being rotationally fixed on the said shaft, the other said lever part being rotationally free on the said shaft, and the said other lever part being connected to the said selecting means for operation thereby.

* * * * *